US005664867A

United States Patent [19]

Martin et al.

[11] Patent Number: 5,664,867

[45] Date of Patent: Sep. 9, 1997

[54] NIGHT LIGHT FOR TOILET SEAT

[75] Inventors: David A. Martin, West Babylon; Robert Fisher, Lindenhurst, both of N.Y.

[73] Assignee: Martin & Fisher, Inc., Ronkonkoma, N.Y.

[21] Appl. No.: 485,635

[22] Filed: Jun. 7, 1995

[51] Int. Cl.[6] ..... F21V 33/00; A47K 17/00

[52] U.S. Cl. ..... 362/101; 362/154; 362/276; 362/802; 4/661

[58] Field of Search ..... 362/101, 96, 154, 362/155, 253, 276, 190, 191, 196, 200, 374, 202, 205, 255, 256; 4/420, 661, 234, 237, DIG. 6; 200/61.52, 61.58 R, 61.62, 61.83

[56] References Cited

U.S. PATENT DOCUMENTS

| | | | |
|---|---|---|---|
| 1,206,186 | 11/1916 | Whelan | 4/234 |
| 1,880,892 | 10/1932 | Dodge | 362/255 |
| 2,206,094 | 8/1940 | Hobbs . | |
| 2,336,677 | 12/1943 | Frey . | |
| 2,361,677 | 10/1944 | Bramhall | 4/239 |
| 2,458,019 | 1/1949 | Niles | 4/233 |
| 2,460,543 | 2/1949 | Spierer | 4/233 |
| 2,465,114 | 3/1949 | Oury | 362/196 |
| 2,616,097 | 11/1952 | Smith | 4/233 |
| 2,721,531 | 10/1955 | Findley | 116/67 |
| 2,766,716 | 10/1956 | Mackey | 116/67 |
| 2,788,764 | 4/1957 | Headlee | 116/67 |
| 2,947,850 | 8/1960 | Reilly . | |
| 3,020,528 | 2/1962 | Swanson | 340/235 |
| 3,045,096 | 7/1962 | Clayton | 219/19 |
| 3,067,352 | 12/1962 | Vodicka et al. | 362/255 |
| 3,137,447 | 6/1964 | Dorman . | |
| 3,982,288 | 9/1976 | Borne | 4/237 |
| 4,413,364 | 11/1983 | Bittaker | 4/661 |
| 4,491,991 | 1/1985 | Herbruck | 4/661 |
| 4,521,833 | 6/1985 | Wolter | 362/200 |
| 4,547,768 | 10/1985 | Kulhavy | 340/620 |
| 4,623,955 | 11/1986 | Santini | 362/135 |
| 4,636,474 | 1/1987 | Ogura | 435/291 |
| 4,731,712 | 3/1988 | Amthor | 362/196 |
| 4,733,419 | 3/1988 | Nee | 4/661 |
| 4,736,471 | 4/1988 | Johnson | 4/234 |
| 4,766,275 | 8/1988 | Hemmann et al. | 200/61.52 |
| 4,849,742 | 7/1989 | Warrington | 340/686 |
| 4,860,178 | 8/1989 | Picon | 362/101 |
| 4,883,749 | 11/1989 | Roberts | 434/247 |
| 4,916,267 | 4/1990 | Lasier et al. | 200/61.62 |
| 5,003,648 | 4/1991 | Anderson | 4/661 |
| 5,036,443 | 7/1991 | Humble | 362/183 |
| 5,123,130 | 6/1992 | Sanders | 4/661 |
| 5,136,476 | 8/1992 | Horn | 4/661 |
| 5,150,962 | 9/1992 | Rauschenberger | 362/101 |
| 5,263,209 | 11/1993 | Pattee | 4/661 |
| 5,276,595 | 1/1994 | Patrie | 362/101 |
| 5,463,537 | 10/1995 | Trattner et al. | 200/61.52 |
| 5,463,539 | 10/1995 | Vandenbelt et al. | 362/196 |

*Primary Examiner*—Ira S. Lazarus
*Assistant Examiner*—Thomas M. Sember
*Attorney, Agent, or Firm*—Alfred M. Walker

[57] ABSTRACT

A night light for a toilet is movement responsive, so that when the toilet seat is lifted up, the light turns on. The switch is preferably a mercury switch. The accessory pair of bumpers can be attached to the toilet seat to insure that the toilet seat is elevated high enough above the width of the light body.

16 Claims, 6 Drawing Sheets

Fig. 6
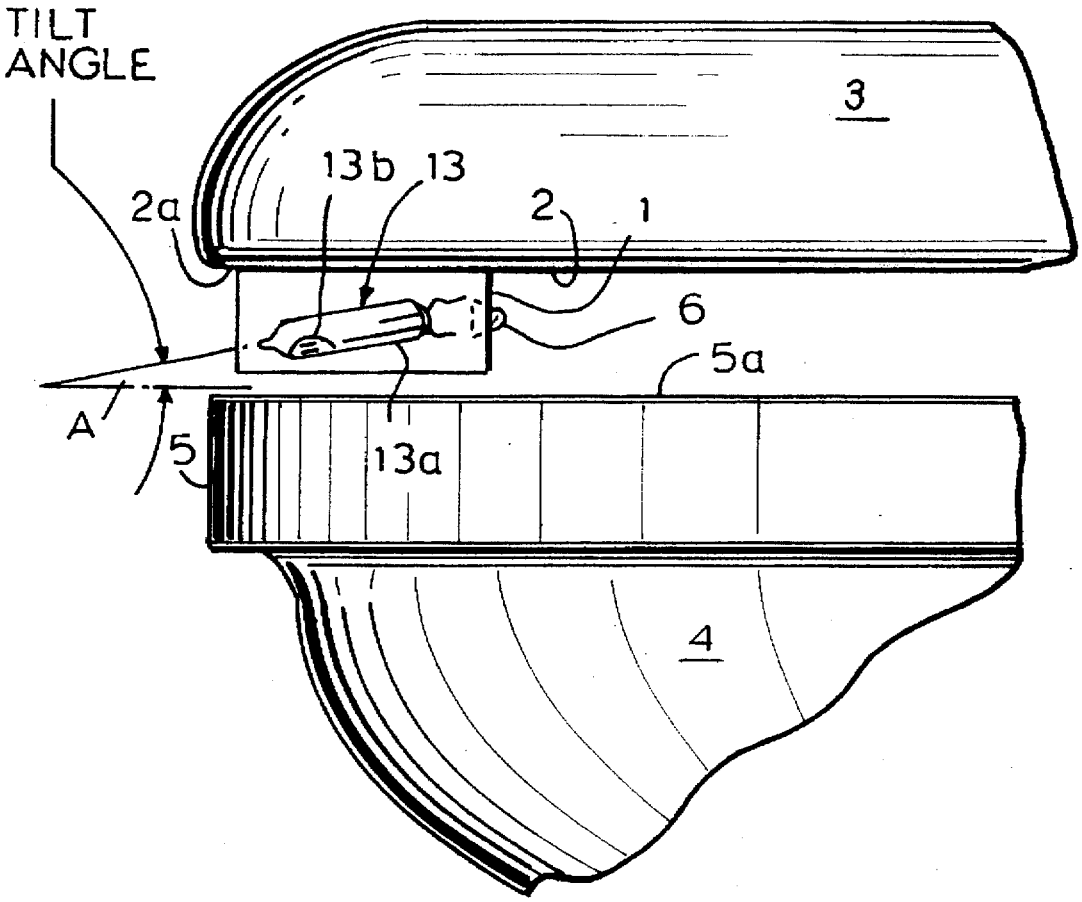
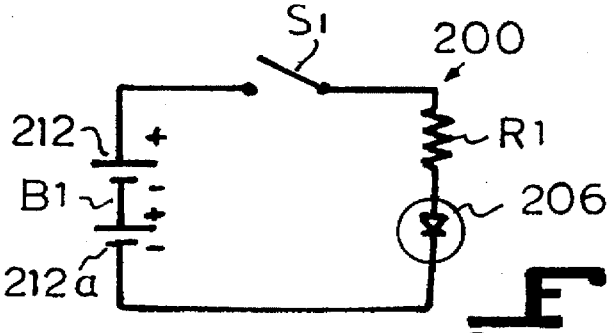
Fig. 7

NIGHT LIGHT FOR TOILET SEAT

FIELD OF THE INVENTION

The present invention is directed to a night light for a toilet seat, wherein the light is movement responsive, so that when the toilet seat is lifted up, the light turns on.

BACKGROUND OF THE INVENTION

Various attempts have been made to illuminate a toilet at night for male users. However, the disadvantages of the prior art are that the lights are attached to the unsanitary rim portion of a toilet bowl, or are placed on the seat at the hinge portion therefore in the vicinity of the unsanitary rim of the toilet bowl.

Among these patents include U.S. Pat. No. 2,206,094 of Hobbs, U.S. Pat. No. 2,336,677 of Frey, U.S. Pat. No. 2,361,677 of Bramhall, U.S. Pat. No. 2,458,019 of Niles, U.S. Pat. No. 2,460,543 of Spierer, U.S. Pat. No. 2,616,097 of Smith, U.S. Pat. No. 2,721,531 of Findley, U.S. Pat. No. 2,766,716 of Mackey, U.S. Pat. No. 2,788,764 of Headlee, U.S. Pat. No. 2,947,850 of Reilly, U.S. Pat. No. 3,020,528 of Swanson, U.S. Pat. No. 3,045,096 of Clayton, U.S. Pat. No. 3,137,447 of Dorman, U.S. Pat. No. 3,982,288 of Borne, U.S. Pat. No. 4,413,364 of Bittaker, U.S. Pat. No. 4,491,991 of Herbruck, U.S. Pat. No. 4,547,768 of Kulhavy, U.S. Pat. No. 4,623,955 of Santini, U.S. Pat. No. 4,636,474 of Ogura, U.S. Pat. No. 4,733,419 of Lee, U.S. Pat. No. 4,736,471 of Johnson, U.S. Pat. No. 4,849,742 of Warrington, U.S. Pat. No. 4,860,178 of Picon, U.S. Pat. No. 4,883,749 of Roberts, U.S. Pat. No. 5,003,648 of Anderson, U.S. Pat. No. 5,036,443 of Humble, U.S. Pat. No. 5,123,130 of Sanders, U.S. Pat. No. 5,150,962 of Rauschenberger, U.S. Pat. No. 5,263,209 of Pattee, and U.S. Pat. No. 5,276,595 of Patrie.

Hobbs '094 describes a gravity actuated light which lights when an automobile hood is raised.

Frey '677 describes a small manually operable reading light.

Smith '097 describes a toilet seat sanitizer which includes a sanitizing light which is actuated by the weight of a user sitting upon the toilet seat. Niles '019 and Spierer '543 also describe an ultraviolet sanitizer for a toilet.

Finley '531, Mackey '716, Headlee '764, Swanson '528 Branthall '677, Roberts '749 and Sanders '130 each describe toilet signaling devices which provide lights, music or other diversions to infants during toilet training.

Reilly '850 describes a light for a toilet which provides a constant illumination of the water within the toilet bowl.

Clayton '096 provides a heat lamp which heats a toilet seat, which is inactivated when the toilet is used.

Dorman '447 describes a telephone light with an activation switch.

Borne '288 describes a translucent lighted toilet seat with a curvilinear light rod therein. It cannot be retrofit to existing opaque toilet seats.

Bittaker '364 describes a light which attaches over the unsanitary toilet bowl rim, and which requires an external wire attached to a switch.

Herbruck '991 describes a combination alarm light and buzzer which is attached to the lid cover, and which is activated when the seat in a lifted vertical position contacts the mechanism on the lid.

Similar to Herbruck '991, the toilet light described in Johnson '471 is activated by lifting of a toilet seat lid cover. However, because the toilet seat covers are usually kept at all hours in an up position, the toilet light of Johnson '471 has a tendency to use up batteries, since rarely is the toilet seat lid cover kept in a lowered position upon the toilet seat. The resultant energy waste causes increased costs of replacement batteries and light bulbs.

Moreover, if a light is placed upon a toilet seat lid cover, it projects outward in an uncomfortable position against a user in the sitting position.

As in Johnson '471, Herbruck '991 also has the disadvantage that the toilet seat lid covers are usually kept in a lifted up position, so the light is kept on constantly, resulting in energy waste and increased costs of replacement batteries and light bulbs.

Humble '443 describes a darkness sensitive night proximity light with a gravity actuated mercury switch, wherein the light is also attached to a toilet seat lid cover, which lid cover is also kept in an raised up position most of the time. Additionally, Humble '443 further describes a light sensor which closes in darkness to illuminate a toilet continuously throughout the night and a movement sensor, to indicate the presence of a person thereat.

Kulhavy '768 provides a switch for detecting water levels within a tank.

Santini '955 describes a toilet with a lighted mirror for medical observation.

Ogura '474 describes a toilet with a sensor in the water for detecting bodily wastes.

Warrington '742 describes an alarm indicator to advise a user to lower an elevated toilet seat. The warning indicator is activated by the flushing of the toilet. Similarly, Nee '419 describes a message indicator which fits under a toilet seat to advise a user that a toilet seat is in an up position.

Picon '178 describes an L-shaped toilet bowl light which attaches to the lower region of the seat, where it is closer to the unsanitary toilet bowl. Because the light is so close to the toilet bowl, the light also does not reflect light over the whole general area of the toilet.

Anderson '648 and Pattee '209 describe toilet bowl lights with cumbersome rim attachments. In Anderson '648, a horseshoe shaped web is placed upon the toilet bowl and in Pattee '209, a lighted transparent tube extends within the toilet bowl along its periphery, and is attached to the bowl by a plurality of attachment means.

Rauschenberger '962 describes a toilet bowl light which fits over the unsanitary toilet bowl rim, which light is activated by a lifting of a contact switch when the toilet seat is lifted up away from the rim.

Finally, Patrie '595 describes a complicated, color coded electronic sensor which senses the presence of a person, in darkness, to light the toilet bowl area.

In general, the prior art describes toilet seat lights which are placed upon or near the unsanitary toilet bowl rim, or upon the toilet seat cover, which results in energy waste since toilet seat lid covers are normally kept in an raised, up position. Other prior art patents also have the disadvantage of being activated by flushing, which requires auxiliary fluid mechanical components.

Moreover, none of the prior art devices provide auxiliary structural bumpers to retrofit the device upon a toilet seat, regardless of the size of existing bumpers.

In addition, none of the prior art devices describe a light body of a simple structural configuration which fits close to the plane of the underside of a toilet seat, as opposed to a toilet seat cover, wherein the configuration of the light emitting end maximizes light distribution therefrom while protecting the lamp bulb from external damage.

OBJECTS OF THE INVENTION

It is an object of the present invention is to provide a novel toilet light which is adaptable to a variety of different toilets to provide soft illumination when the seat is raised.

Another object is to provide a novel self-contained battery-powered light unit.

Another object is to provide a light unit which is mounted in an area that is least subject to unsanitary contamination.

It is yet another object of the present invention to provide a toilet light which avoids contact with an unsanitary toilet bowl rim.

Another object is to provide a light unit and accessories which are inexpensive to manufacture.

Another object is to provide a toilet light unit which is reliable, easy to service, and requires no tools for installation.

It is yet another object to provide a light unit for a toilet having a body of a simple, relatively flat structural configuration, which fits close to the plane of the underside of a toilet seat, wherein the configuration of the light emitting end maximizes light distribution therefrom while protecting the lamp bulb from external damage.

It is another object of the present invention to provide an illuminated night light for a toilet, wherein the light is movement responsive, so that when the toilet seat is lifted up, the light turns on.

It is yet another object of the present invention to provide a toilet light which maximizes the illuminated area of a toilet.

It is yet another object to provide a toilet light which can be retrofit to existing opaque toilet seats.

It is yet another object to improve over the disadvantages of the prior art.

SUMMARY OF THE INVENTION

In keeping with these objects and others which may become apparent, this invention relates to a toilet light unit which is adapted to be mounted on the toilet seat for illuminating the toilet bowl when the seat is raised.

To that end, the present invention includes a hollow night light housing body for illuminating a toilet bowl, wherein the light has a switch which is movement responsive, so that when the toilet seat is lifted up, the light turns on. Moreover, the switch is preferably a mercury switch, or alternately a trip switch.

To be able to be retrofitted to any toilet, the night light of the present invention includes an accessory pair of bumpers which can be attached to the toilet seat adjacent to the night light, to insure that the toilet seat is elevated high enough above the width of the light body, even if the night light body is thicker than the existing bumpers on a toilet seat.

The night light attaches to the bottom of the toilet seat, at the front portion thereof, so that when the seat is elevated by a male user, to a vertical position away from the toilet bowl, the light is attached at the top of the elevated seat. Therefore, the illuminated area is maximized, as opposed to toilet bowl rim-oriented prior art lights, which light a limited illuminated bowl area, and which are placed in unsanitary positions upon or near the rim of the toilet bowl.

The light, which is therefore attached to a front portion of the underside of the seat, is activated when the seat is lifted, which covers the switch to be activated during the elevated position of the seat. When the seat is placed down upon the bowl, the night light turns off.

Since the light is placed at the front of the underside of the toilet seat, it is in the highest position isolated from and above the toilet seat when a male user urinates into the toilet seat bowl.

In the aforesaid isolated position of use, the light unit of the present invention comprises a small battery-powered light fixture with a very low intensity bulb that is attached to the bottom of the toilet seat and is equipped with a switch within the housing, such that when the seat is lifted, the circuit will close to emit a small amount of light to enable a person to see the bowl. The night light is especially useful to males so that they do not miss the bowl when urinating. It also acts as an incentive to lower the seat, because that is the only way to turn off the light.

The structural configuration of the lid light of the present invention includes a box shaped housing, preferably plastic, with dimensions of approximately two to three inches in length, one and one-half inches in width and one-quarter to one half inch in thickness. The box shaped housing of the light unit for a toilet is made of a simple, relatively flat structural configuration, which fits close to the plane of the underside of a toilet seat, wherein the configuration of the light emitting end maximizes light distribution therefrom while protecting the lamp bulb from external damage.

The light attaches to the toilet bowl seat with an adhesive or VELCRO hook and strong loop type fastener patches on the housing and toilet seat, so the light can be adhered to the underside of the toilet seat where it remains out of the way when not in use.

The housing of the light unit is placed at a top region of the underside of the toilet seat, so that the emitted illumination shines down when the seat is up.

The present invention is equipped with a movement responsive switch, such as a mercury switch, that is placed within the housing so the circuit is only activated when the toilet seat is in an up position.

DESCRIPTION OF THE DRAWINGS

The present invention can best be understood in conjunction with the accompanying drawings, in which:

FIG. 6 is a side elevational view showing the tilt angle of the mercury switch in the off position.

FIG. 7 is a schematic diagram of an alternate embodiment.

DETAILED DESCRIPTION OF THE PREFERRED EMBODIMENT

Figure 1:
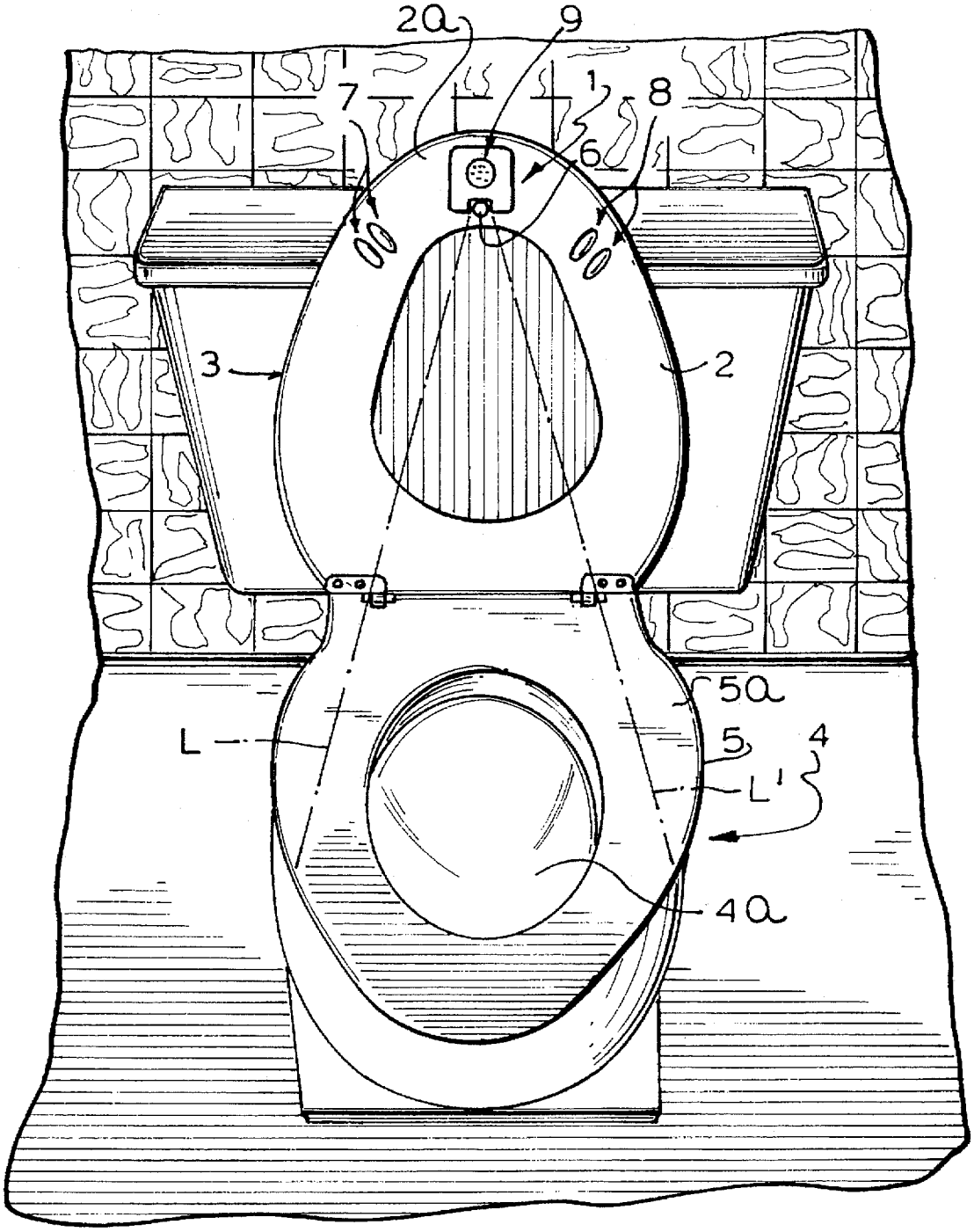
FIG. 1 is a front perspective view showing the present invention in operation.

As shown in FIG. 1–6 and FIG. 8, the present invention includes hollow toilet light unit 1, such as a hollow housing body, adapted to be mounted upon a front region 2*a* of an underside 2 of a toilet seat 3 for illuminating the toilet bowl 4 and rim 5 of toilet bowl 4 when a male user urinates into toilet bowl 4 at night in an unlit bathroom. When seat 3 is lifted to an up position, the illumination provided by lamp 6 shines downward toward toilet bowl 4. In the position of rest, toilet light 1 is in an inverted horizontal position upon underside 2 underneath toilet seat 3. When in use, toilet seat 3 is lifted up and rotated to a vertical up position, so that lamp 6 shines downward into toilet bowl 4.

Light unit 1 for toilet bowl 4 is made of a body of a simple, relatively flat structural configuration, which fits close to the plane of the underside 2 of toilet seat 3.

Figure 5:
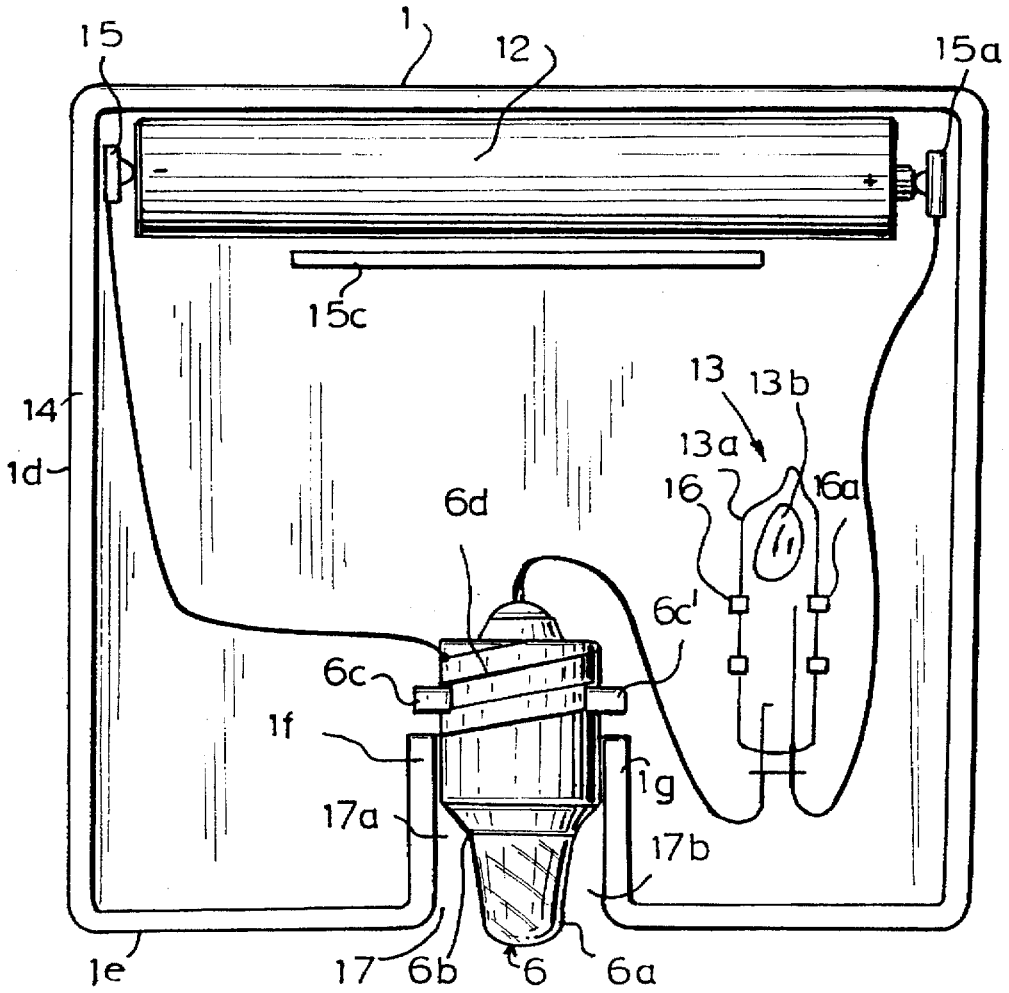
FIG. 5 is a top plan view of one embodiment of the light unit with the top cover removed to show the placement of the components.
Figure 8:
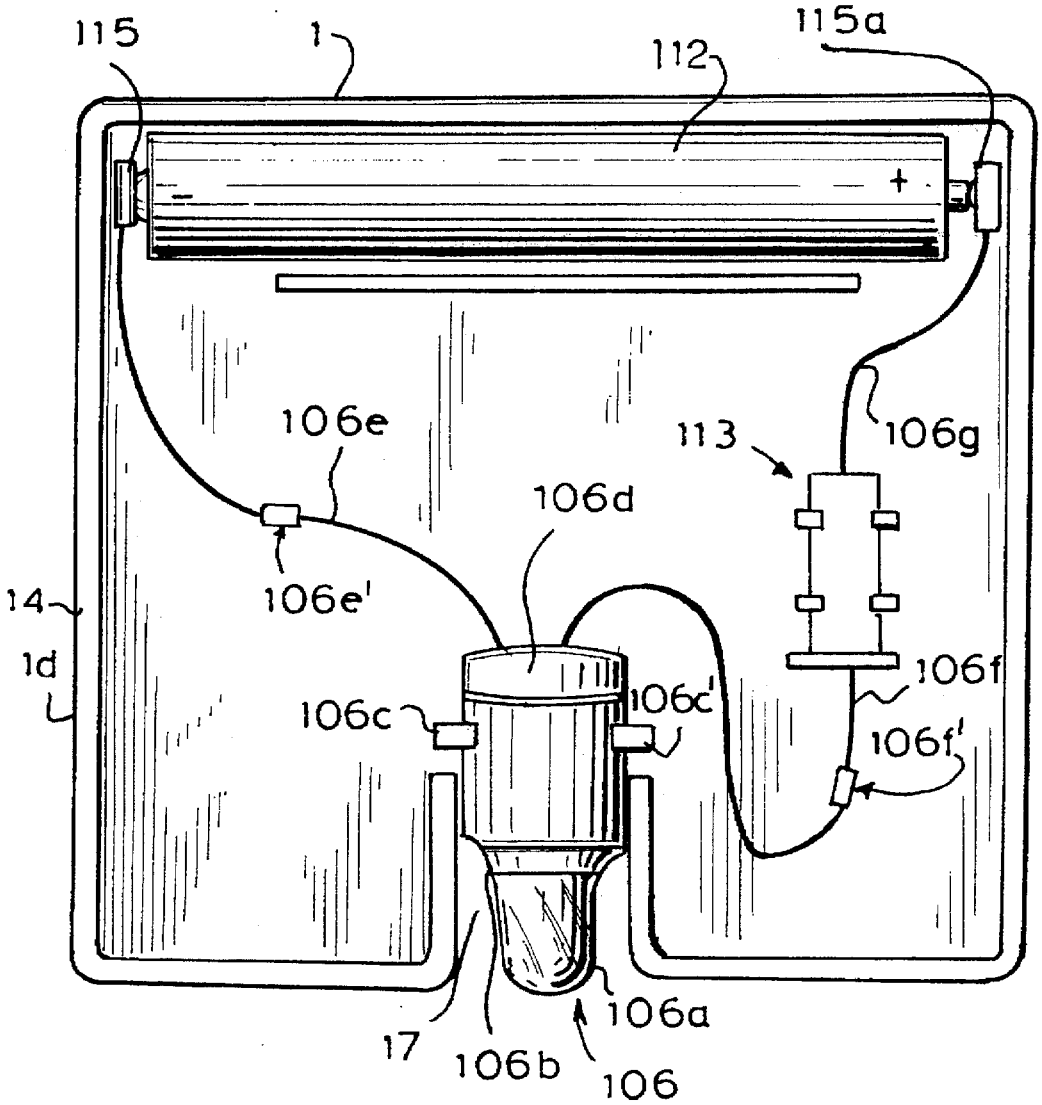
FIG. 8 is a top plan view of the preferred embodiment of the light unit with the top cover removed to show the placement of the components.
Figure 8A:
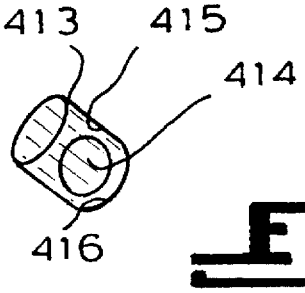

Illumination is provided by screw-in threaded light bulb 6 as shown in FIG. 5, or preferably by insertable, unthreaded light bulb 106, as shown in FIG. 8. Light bulb 6 includes illumination bulb portion 6*a* and electrical base component member 6*b*. Light bulb 6 is attached to holding members 6*c*, 6*c*' either by screw in threaded members 6*d* as shown in FIG. 5, or by non-threaded direct contact body 106*d* of bulb 106, in the preferred embodiment shown in FIG. 8.

In the preferred embodiment shown in FIG. 8, light bulb 106 also includes illumination bulb portion 106*a* and electrical base component 106*b*, which is inserted within holding members 6*c*, 6*c*'.

In this preferred embodiment shown in FIG. 8, light bulb 106 is attached to crimps 106*e*' or 106*f* of crimp wires 106*e*, 106*f* respectively. Wire 106*e* connects to negative contact 115 connected to battery 112, and wire 106*f* connects to mercury switch 113, which is further connected by wire 106*g* to positive contact 115*a*, connected to battery 112.

As shown in FIG. 1, toilet light unit 1 is attached to a top region 2*a* of underside 2 of toilet seat 3. The supplied bumpers 7,8 are used to insure adequate vertical clearance for toilet light unit 1 from the upper surface 5*a* of toilet bowl rim 5 when toilet seat 3 is lowered to a position of non-use. The position of toilet light unit 1 causes light bulb 6 or light bulb 106 to shine light on the entire surface of toilet bowl 4 when toilet seat lid is up, as noted in the sector defined by dashed lines L—L' in FIG. 1.

Also, it can be appreciated that the mounting position of toilet light 1 at a top region 2*a* of underside 2 of toilet seat 3 is optimal for shielding light unit from splashing, either in the seat up position for male urination, or for use with toilet seat 3 down, when any splashing tends to be directed further back.

Figure 2:
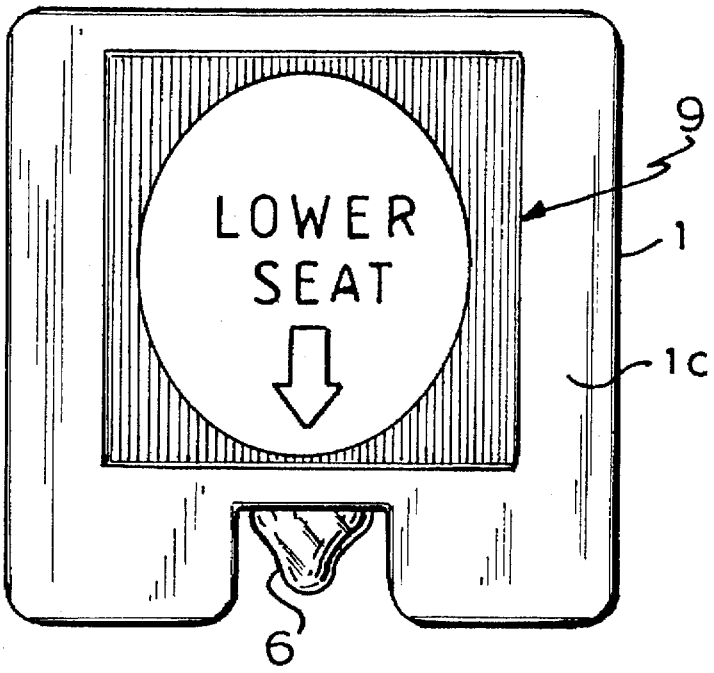
FIG. 2 is a top plan view of the light unit.
Figure 3:
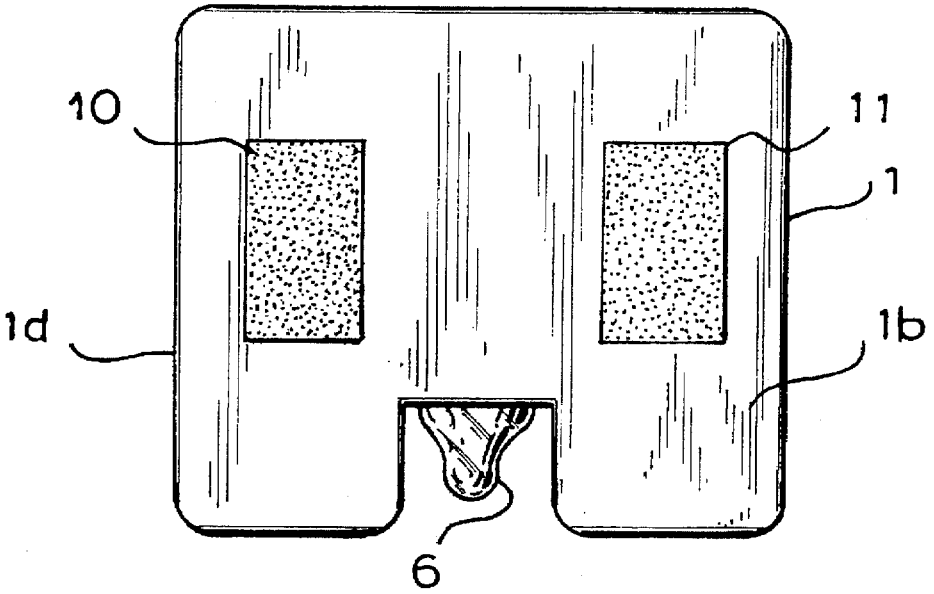
FIG. 3 is a bottom view of the light unit.

Supplied seat bumpers 7,8 have one or more adhesive strips 10, 11 attached for mounting, with a release liner layer. Toilet light unit 1 itself, as shown in FIG. 2, has one or more corresponding adhesive strips 10, 11 on a bottom surface 1*b* of base 1*d*, as shown in FIG. 3.

Alternatively, these fasteners can be "Loop" patches which mate with "Hook" patches of a "Hook and Loop" fastener VELCRO® type system such as provided by Velcro Corporation. In the case that toilet light unit 1 is attached to toilet seat 3 using this technique, the Hook patch or patches are adhesively bonded to toilet seat 3. Then, toilet light unit 1 includes removable cover 1*c* for cleaning or for service of the power source, such as changing battery 12. Finally, decal 9 is included to visually remind the user of the toilet to lower toilet seat 3 after use.

Decal 9 is desirable since lamp 6 of toilet light 1 is not too strong and may be overlooked in a well lighted bathroom. While lamp bulb 6 itself is a reminder in dark use of toilet light 1, leaving toilet seat 3 up could drain battery 12.

In the preferred embodiment, light unit 1 is quite small, measuring 2.14" by 2.00" by 0.52" (54 mm by 51 mm by 13 mm). Housing 14 of toilet seat light 1 includes two parts, including cover 1*c* and base 1*d*, which snap together. Bottom base portion 1*d* contains all the components, while top cover part 1*c* acts as a lid to seal the enclosure of toilet light unit 1. The user can pry the two sections 1*c*, 1*d* apart by using slots on either side to gain access for battery replacement.

In case the original bumpers of toilet seat 3 are too narrow to accommodate light unit 1 within the space provided between toilet seat 3 and toilet bowl rim 5, supplied bumpers 7,8 are approximately 0.60" (15 mm) high to insure adequate clearance for toilet light unit 1 away from toilet bowl rim 5.

Figure 4:
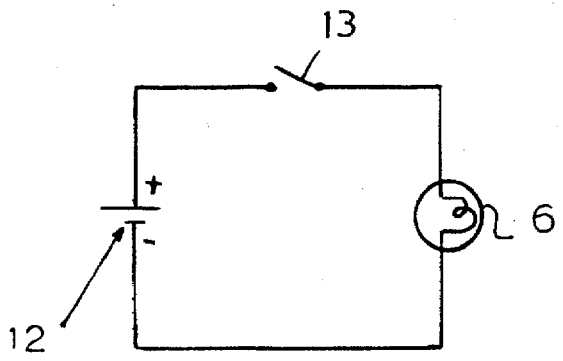
FIG. 4 is a schematic diagram of the preferred embodiment.

As shown in FIG. 4, the electrical circuit consists of a single-cell battery 12 as a power source, a tilt-sensing mercury switch 13 and an incandescent lamp 6, which components 6, 12, 13 are shown in FIG. 5. Battery cell 12 is preferably an AAA alkaline battery cell which is held in place between two spring contacts 15, 15*a* and a plastic barrier 16, which is part of housing 14 of light unit 1. Mercury switch 13 is shown as a hermetically sealed housing 13*a*, which may be metal or another appropriate material, containing a small amount of mercury 13*b* that selectively bridges the two sealed contacts 15, 15*a*, depending on the locational tilt of switch 13.

Other alternate embodiments for a switch are available.

Mercury switch 13 is held to housing 14 by two integrally molded plastic clips 16, 16*a*. Clips 16, 16*a* maintain the appropriate tilt angle A, as shown in FIG. 6, to insure that lamp 6 of light unit 1 goes off when toilet seat 3 is in the lowered position, as shown in FIG. 6. No manual switch is provided in the preferred embodiment, since little use exists for its addition. Lamp 6 used is rated at 2.2 volts and 0.25 amperes. A type 222 Radion brand lamp from SPC Technology is an example. This type of lamp 6 has an integral lens 6*a* molded into the glass bulb 6*a* which focuses the light in the appropriate area region defined within the dashed lines L, L', as shown in FIG. 1.

The configuration of the light emitting front end 1*e*, such as a wall, maximizes light distribution of lamp bulb 6 or lamp bulb 106 therefrom while protecting lamp bulb 6 or lamp bulb 106 from external damage. Consequently, in order to maximize the illumination of sector L—L' upon toilet seat bowl 4 and toilet bowl rim 5, lamp 6 or lamp 106 are each provided within a recess 17 provided within front end 1*e* of light unit 1 so that gaps 17*a*, 17*b* are provided between recess walls if, 1*g* of light unit 1. Therefore, lamp 6 projects outward from recess 17 in a sector defined by lines L—L' of FIG. 1.

Moreover, to protect light bulbs 6 or 106 from damage, bulb 6 or bulb 106 extend to about the edge of front end 1*e* of light unit 1.

While the drawing FIGS. 1–8 generally show a box type shape, such as a generally flattened parallelepiped, it is known that other generally flattened shapes would be intended. For example, as shown in FIGS. 9 and 9A ,light unit 301 comprises a generally flattened cylinder, wherein a front light emitting end 301*e* is a convex portion of generally flattened cylindrical light body 301, having a recess 317 therein for insertion of light bulb 306 therein.

Figure 9:
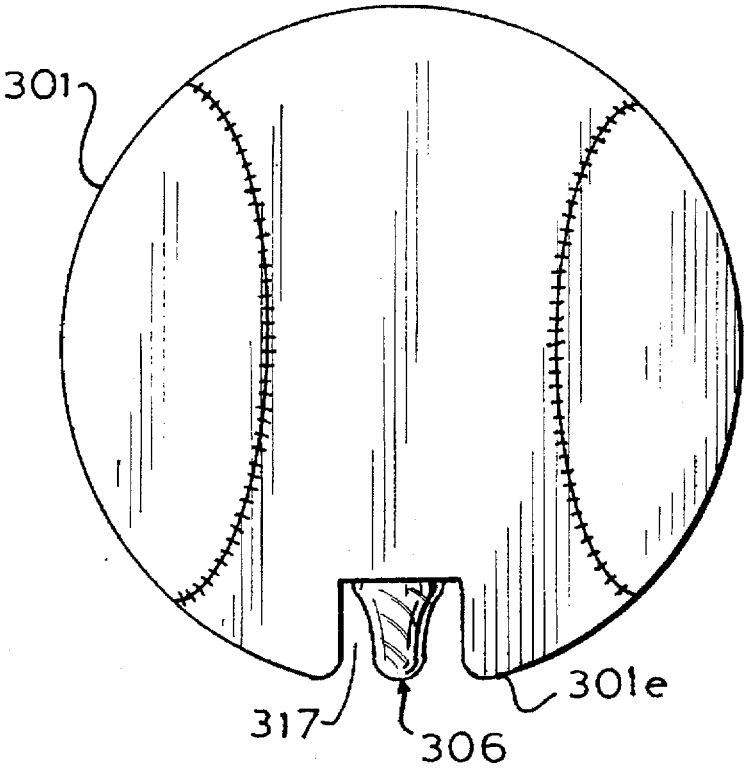
FIG. 9 is a top plan view of an alternately configured light unit.
Figure 9A:
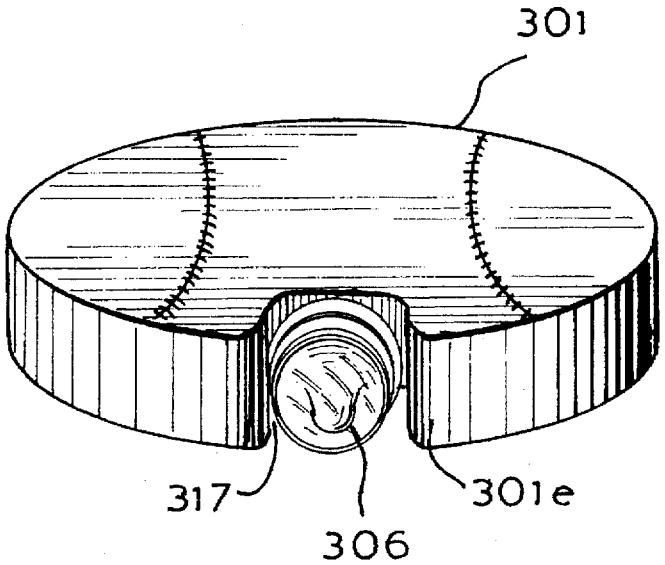
FIG. 9A is a perspective view of the alternately configured light unit as in FIG. 9.

Moreover, light unit 301 may have an amusement related surface ornamentation or indicia, such as a simulated stitching marks of a baseball, as shown in FIGS. 9 and 9A. It is asserted, however, that other amusement related surface ornamentation or indicia may be affixed to cylindrical light unit 301, such as the curved seams, stippled surface and tan color of a basketball, or the plurality of pentagon shaped seams of a soccer ball. Moreover, licensed cartoon characters, licensed sports logos, such as professional baseball, hockey, basketball or football teams may be affixed to light unit 301, to attract a child's interest when urinating at night.

While the preferred embodiment of the present invention is for a toilet light, it is known that other uses are applicable in low light environments, such upon a lid of a hollow container with a hinged cover, such as a camping cooler or tool box, for use in poorly lit areas, such as at a wooded campsite or upon a darkened roadside at night.

By using a lamp, such as bulb 6 or bulb 106, rated at 2.2 volts at a nominal 1.5 volts provided by the single AAA cell, three advantages are realized. First, a softer light is provided which makes it easier to return to sleep. Secondly, the life of bulb 6 or bulb 106 is greatly extended, thereby permitting direct soldering of the connections; this saves the cost of a socket which would permit replacement of bulb 6 or lamp bulb 106. A third advantage is longer battery life. At 2.2 volts, lamp bulb 6 or lamp bulb 106 is designed to draw 250 milliamps, at 1.5 volts as used in the present invention, it only draws approximately 100 milliamps thereby extending battery life by over a factor of two.

An alternate type of tilt-sensitive switch 413 can be used instead of mercury switch 13. One type is a "ball and cage" design whereby a small metal ball 414 selectively bridges two electrical contacts 415, 416 depending on the tilt of the switch 413. One design of such a switch is a small insulating cylinder with two or more contacts 415, 416 surrounding a captive ball 414. If this type of switch 413 is used in toilet light unit 1, it too must be angled properly by mounting clips to insure the off position in the "down seat" position. An advantage to using this type of switch 413 is elimination of the mercury contamination hazard when discarding an inoperative toilet light 1. The mercury type tends to be more reliable however.

FIG. 7 shows the schematic diagram for an alternate embodiment for a lid light 200 using a light emitting diode (LED) light source 206 instead of an incandescent lamp. A disadvantage of this approach is that usually voltage higher than the 1.5 volts available from a single alkaline cell is required by the LED 206. The battery shown consists of two AAA cells 212, 212*a*, shown at B1 in FIG. 7 wired in series thereby providing 3 volts. Switch (S1) can be any type of tilt sensitive single pole switch as described above. R1 is a current limiting resistor. If a type H/KR Hi-Super Bright LED from Stanley Electric Co., Ltd. is used, the resistor value would be 50 ohms to limit the current to 20 milliamps. Preferably LED 106 provides a red colored light. Other colors of LED's are also available. Adequate light can be provided at a fifth of the current drawn by incandescent lamp 6 thereby greatly extending the life of the batteries 212, 212*a*, although two cells 212, 212*a* are required.

In general, night light unit 1 of the present invention provides a discrete illumination after lighted region defined between lines L, L' in FIG. 1 to provide an illumination of interior 4*a* of toilet bowl 4, for male urination at night. Lamp 6 of toilet light unit 1 is activated by a movement responsive switch 13, such as a mercury switch, so that when toilet seat 3 is rotated upward away from rim 5 of toilet bowl 4, the mercury 13*a* within switch 13 moves and closes electrical contacts 15, 15*a* at battery 12 of light unit 1, thereby causing lamp 6 to shine.

It is noted that other modifications may be made to the present invention without departing from the scope of the present invention, as noted in the appended claims.

We claim:

1. A night light in combination with a toilet, the combination comprising:

a toilet having a bowl with a rim at an upper end thereof, said toilet having a hinged toilet seat movable from a horizontal position of use to a generally vertical position of rest, a hollow light body, said hollow light body including a cover member spaced apart from and joinable to a base member, said hollow light body enclosing therein a power source connected to a light source, said body further including a switch, said switch being movement responsive, so that when said toilet seat of said toilet is lifted vertically up, said switch closes a pair of contacts located adjacent to said power source, said switch providing electrical power to said power source for providing power to said power to light source, said hollow light body having a generally flattened shape, said light body having a recess at a front light emitting end thereof, said recess including a pair of oppositely positioned walls extending inward from said front light emitting end of said hollow light body, said light source insertable within said recess of said front light emitting end, said light source having an outer end extending outward to a plane coincidental to and parallel to an outer edge of said front light emitting end, said light source directed downward toward the toilet bowl and illuminating the toilet bowl, said hollow light body extending parallel to a plane of an underside of said toilet seat, said recess providing a gap separating said light source from each of said oppositely positioned walls extending inward from said front light emitting end of said hollow light body, said hollow light body being fastened to a front end of an underside of said toilet seat, wherein in a position of use, said light source of said light unit is directed downward and illuminates the toilet bowl from above.

2. The night light as in claim 1, wherein said switch is a mercury switch.

3. The night light as in claim 2, further comprising a single battery cell functioning as a power source, said tilt-sensing mercury switch communicating with an incandescent lamp, said battery being held in place between two spring contacts, said mercury switch being hermetically sealed housing containing a movable amount of mercury that selectively bridges said two sealed contacts, depending on a tilt angle of said switch.

4. The night light as in claim 3 wherein said incandescent lamp is rated at 2.2 volts and 0.25 amperes, wherein at 2.2 volts, said lamp bulb is designed to draw 250 milliamps, said incandescent lamp having an integral lens molded into a glass bulb, said lens focusing the light in a predetermined area of said toilet bowl, said incandescent lamp using 1.5 volts, wherein said incandescent lamp only draws approximately 100 milliamps, thereby extending battery life of said battery by over a factor of two.

5. The night light as in claim 1, wherein said switch is a tilt switch.

6. The night light as in claim 1 further comprising an accessory pair of bumpers, said bumpers attachable to a bottom side of said toilet seat, said bumpers elevating said toilet seat high enough above a rim of said toilet bowl to accommodate said light body.

7. The night light as in claim 1, wherein when the toilet seat is placed horizontally upon the toilet bowl, said switch of said night light turns off the electrical power from said power source to said light source.

8. The night light as in claim 1, wherein said light source includes a low intensity bulb, wherein further when the toilet seat is lifted, said switch closes causing said light source to emit sufficient light to view said toilet bowl.

9. The night light as in claim 1 further comprising said housing body having an adhesive on said housing body, said toilet seat having a corresponding adhesive means, for fastening said light unit to said underside of said toilet seat.

10. The night light in combination with a toilet as in claim 1, further comprising a pair of toilet seat bumpers and an indicator decal, said bumpers providing adequate clearance for said night light away from a surface of a rim of said toilet bowl of the toilet, when the seat is lowered upon the rim, said seat bumpers having fasteners for mounting said seat bumpers of said light unit to said toilet seat.

11. The night light as in claim 1 further comprising a tilt-sensitive switch including a ball and cage housing having a movable ball selectively bridging two electrical contacts depending on the tilt of said switch.

12. The night light as in claim 1 wherein said hollow light body is a generally flattened box shaped parallelepiped having said recess in a front end wall.

13. The night light as in claim 1 wherein said hollow light body is a generally flattened cylinder having said recess in a convex front end portion thereof.

14. The night light as in claim 13, wherein said hollow light body is adorned with amusement related surface ornamentation indicia.

15. A night light in combination with a hollow container having a hinged cover, the combination comprising:

a container having a hollow interior with a rim at an upper end thereof, said hollow container having a hinged cover movable from a horizontal closed position to a generally vertical open position, a hollow light body, said hollow light body including a cover member spaced apart from and joinable to a base member, said hollow light, said body enclosing therein a power source connected to a light source, said body further including a switch, said switch being movement responsive, so that when said cover of said hollow container is lifted vertically up, said switch closes a pair of contacts located adjacent to said power source, said switch providing said electrical power to said power source for providing power to said light source, said hollow light body having a generally flattened shape, said light body having a recess at a front light emitting end thereof, said recess including a pair of oppositely positioned walls extending inward from said front light emitting end of said hollow light body, said light source insertable within said recess of said light emitting end, said light source having an outer end extending outward to a plane coincidental to and parallel to an outer edge of said light emitting end, said light source directed downward toward the hollow container and illuminating the hollow container, said hollow light body extending parallel to a plane of an underside of said hinged cover, said recess providing a gap separating said light source from each of said oppositely positioned walls extending inward from a light emitting end of said hollow light body, said hollow light body being fastened to a front end of an underside of said hinged cover, wherein in an open position of use, said light source of said light unit is directed downward and illuminates said hollow container from above.

16. The night light as in claim 15, wherein said hollow light body is adorned with amusement related surface ornamentation indicia.

* * * * *